US009536691B1

(12) United States Patent
Davis et al.

(10) Patent No.: US 9,536,691 B1
(45) Date of Patent: Jan. 3, 2017

(54) AXIAL RELAY

(71) Applicant: Google Inc., Mountain View, CA (US)

(72) Inventors: Ryan T. Davis, Mountain View, CA (US); Jyoti Sastry, San Jose, CA (US); Ankit Somani, Sunnyvale, CA (US); James C. Schmalzried, San Jose, CA (US)

(73) Assignee: Google Inc., Mountain View, CA (US)

( * ) Notice: Subject to any disclaimer, the term of this patent is extended or adjusted under 35 U.S.C. 154(b) by 32 days.

(21) Appl. No.: 14/796,105

(22) Filed: Jul. 10, 2015

Related U.S. Application Data

(60) Provisional application No. 62/022,903, filed on Jul. 10, 2014.

(51) Int. Cl.
*H01H 50/64* (2006.01)
*H01H 50/18* (2006.01)
*H01H 50/58* (2006.01)

(52) U.S. Cl.
CPC ..... *H01H 50/64* (2013.01); *H01H 50/18* (2013.01); *H01H 50/58* (2013.01)

(58) Field of Classification Search
CPC ..... H01H 50/64; H01H 50/18; H01H 50/58; H01H 1/06
See application file for complete search history.

(56) References Cited

U.S. PATENT DOCUMENTS 1,764,369 A * 6/1930 Van Sickle ..... H01H 1/54 335/195
2,447,230 A * 8/1948 Brown ..... H02M 7/62 307/132 R
2,725,440 A 11/1955 Kamm
3,023,290 A * 2/1962 Jennings ..... H01H 33/66 218/118
3,161,749 A * 12/1964 Perry ..... H01H 33/6664 200/275
3,219,781 A 11/1965 Miller et al.
3,699,486 A * 10/1972 De Lucia ..... H01H 51/28 218/118
4,047,135 A * 9/1977 Stuckert ..... H01H 51/288 200/214
4,232,281 A 11/1980 Smith
4,594,489 A * 6/1986 Gengenbach ..... H01H 1/365 218/117

(Continued)

FOREIGN PATENT DOCUMENTS

WO WO 2014062114 A1 * 4/2014 ..... H01H 79/00

*Primary Examiner* — Mohamad Musleh
(74) *Attorney, Agent, or Firm* — Fish & Richardson P.C.

(57) ABSTRACT

This specification describes axial relays. One of the axial relays includes first and second adapters positioned along an axis defining an axial direction, a contact extending along the axial direction between the first adapter and the second adapter, and a driver configured to move the contact relative to at least one of the first and second adapters between a first position and a second position by moving the contact along the axial direction or rotating the contact around the axial direction, such that a first end of the contact is conductively coupled to the first adapter and a second end of the contact is conductively coupled to the second adapter when the contact is at the first position, and the first adapter is conductively decoupled from the first end of the first adapter when the contact is at the second position.

20 Claims, 5 Drawing Sheets

(56) References Cited

U.S. PATENT DOCUMENTS

| | | | | |
|---|---|---|---|---|
| 4,660,012 | A | 4/1987 | Bonniau et al. | |
| 5,144,270 | A | 9/1992 | Schedele et al. | |
| 5,572,176 | A | 11/1996 | Heinzl et al. | |
| 6,046,418 | A | 4/2000 | Feiler et al. | |
| 6,094,116 | A | 7/2000 | Tai et al. | |
| 8,593,016 | B2 | 11/2013 | Pelrine et al. | |
| 2007/0212928 | A1* | 9/2007 | Elrick | H01H 1/5833 439/497 |
| 2015/0270084 | A1* | 9/2015 | Karlsson | H01H 79/00 335/102 |

* cited by examiner

AXIAL RELAY

CROSS-REFERENCE TO RELATED APPLICATION

This application claims the benefit and priority of U.S. Provisional Application No. 62/022,903, filed Jul. 10, 2014, the disclosure of which is expressly incorporated herein by reference in the entirety.

BACKGROUND

This specification relates to electrical switches, and particularly to relays.

A relay is an electrically operated switch. In some cases, a relay uses an electromagnet to mechanically operate a switch, e.g., by using a cantilever beam or an armature controlled with magnetics to open and close the relay. The relay can be mounted to a circuit board or terminal block.

SUMMARY

This specification describes an axial relay that can be flexibly mounted to a wire. The relay controls conductive coupling between two adapters positioned along an axial direction by relatively moving a contact between the two adapters along the axial direction or rotating the contact around the axial direction.

In general, one innovative aspect of the subject matter described in this specification can be embodied in a relay that includes first and second adapters positioned along an axis defining an axial direction, a contact extending along the axial direction between the first adapter and the second adapter, and a driver configured to move the contact relative to at least one of the first and second adapters between a first position and a second position by moving the contact along the axial direction, such that a first end of the contact is conductively coupled to the first adapter and a second end of the contact is conductively coupled to the second adapter when the contact is at the first position, and the first adapter is conductively decoupled from the first end of the first adapter when the contact is at the second position.

In another general embodiment, a relay includes first and second adapters positioned along an axis defining an axial direction, a contact extending along the axial direction between the first adapter and the second adapter, and a driver configured to move the contact relative to at least one of the first and second adapters between a first position and a second position by rotating the contact around the axial direction, such a first end of the contact is conductively coupled to the first adapter and a second end of the contact is conductively coupled to the second adapter when the contact is at the first position, and the first adapter is conductively decoupled from the first end of the first adapter when the contact is at the second position.

The foregoing and other embodiments can each optionally include one or more of the following features, alone or in combination. For instance, the relay can include a magnet attached to the contact, and the driver can include an electromagnet configured to generate a magnetic force to move the magnet, thereby moving the contact. In some examples, the magnet has axial magnetization with coplanar surfaces of opposed polarities perpendicular to the axial direction, and the driver is configured to generate an axial magnetic force to move the magnet and thus the contact along the axial direction. In some examples, the magnet has radial magnetization with coplanar surfaces of opposed polarities parallel to the axial direction, and the driver is configured to generate a radial magnetic force to rotate the magnet thus the contact around the axial direction. The contact can include a nonconductive or recess portion, and when the contact is rotated to the second position, the first adapter is coupled to the nonconductive portion or at the recess portion, such that the first adapter is conductively decoupled from the second adapter.

The driver can be configured to receive a first current to generate a first magnetic force to move the magnet and thus the contact from the first position towards the second position. In some cases, the driver is configured to receive a second, opposite current to generate a second magnetic force to move the magnet thus the contact from the second position towards the first position. In some cases, the relay includes a biasing member configured to bias the contact towards the first position.

In some implementations, the contact includes a cylindrical tube having an axis parallel to the axial direction, and the tube is sized such that the first adapter can be in touch with an inner surface of the tube when the first adapter is partially within the tube. In some examples, the first adapter includes a first spring loaded finger extending inwardly and having a first apex, and the first apex is in conductive contact with an inner surface of the cylindrical tube when the contact is at the first position and detached from the inner surface of the cylindrical tube when the contact is at the second position. The second adapter can include a second spring loaded finger extending inwardly and having a second apex, and the second apex maintains in conductive contact with the inner surface of the cylindrical tube when the contact moves between the first position and the second position.

In some implementations, the first adapter includes a first spring loaded finger extending outwardly and having a first bottom, and the first bottom is in conductive contact with an outer surface of the contact when the contact is at the first position and detached from the outer surface of the contact when the contact is at the second position. The second adapter can include a flexible member conductively coupling the second terminal to the contact, the flexible member having a length such that the flexible member maintains the conductive coupling with the contact and the second terminal without breakage when the contact is moved between the first position and the second position.

In some cases, the relay includes a magnet coupled to one of the first and second adapters. The contact is conductively coupled to the other one of the first and second adapters, and the driver is configured to generate a magnetic force to move the magnet and thus the one of the first and second adapters.

The relay can include a housing for enclosing the first and second adapters, the contact, and the driver. The relay can also include first and second terminals conductively coupled to the first and second adapters, respectively. The first and second terminals can be arranged outside of the housing for conductively coupling to a working circuit.

Particular embodiments of the subject matter described in this specification can be implemented to realize one or more advantages. First, an axial relay can be small, compact, light, and cost-effective. Second, the axial relay can be flexible and mounted to a wire, floating in the air, which makes it convenient to be used in any suitable circuits or systems, e.g., a residential or light industrial circuit breaker. Third, the axial relay can be used inside a custom breaker box and allow to meet installation and regulatory requirements. Fourth, the axial relay can be used in any suitable applications requiring power relays such as current relays or breakers.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTIONS OF DRAWINGS

Like reference numbers and designations in the various drawings indicate like elements.

DETAILED DESCRIPTION

Figure 1:
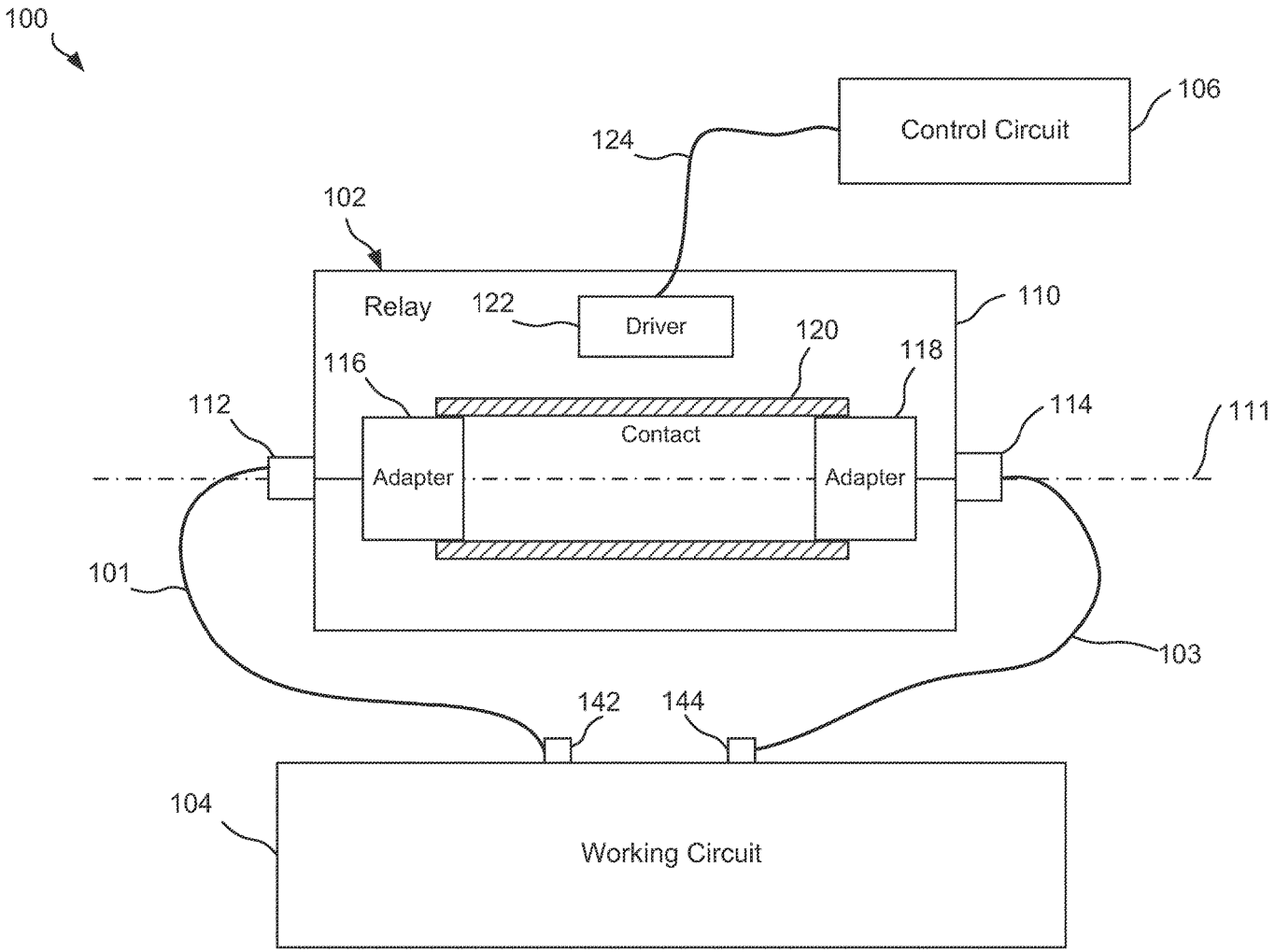
FIG. 1 is a block diagram of a system including an example relay.

FIG. 1 is a block diagram of an example electrical system 100 including an example relay 102, a working circuit 104, and a control circuit 106. The relay 102 can be controlled by the control circuit 106 to be closed or open, thereby controlling a current flowing through the working circuit 104.

The relay 102 includes two electrical terminals 112 and 114, e.g., at input and output ends of the relay 102, respectively. The relay 102 can be bi-directional, and current can flow either from the first terminal 112 to the second terminal 114 or vice versa. The terminals 112 and 114 can have any suitable shapes or types for wire attachment, e.g., crimps, solder cups, or metal pins.

The terminals 112 and 114 can be conductively coupled to electrical terminals 142 and 144 of the working circuit 104, e.g., directly or indirectly by wires 101 and 103, respectively. In some examples, when the relay 102 is closed, the terminal 112 is conductively coupled to the terminal 114, thereby the terminal 142 is conductively coupled to the terminal 144, and consequently the working circuit 104 is on. When the relay is open, the terminal 112 is conductively decoupled from the terminal 114, thereby the terminal 142 is conductively decoupled from the terminal 144, and consequently the working circuit 104 is off.

The relay 102 includes two adapters 116 and 118 conductively coupled to the terminals 112 and 114, respectively, e.g., by wires or direct welding attachment. The terminals 112 and 114 can define an axial direction 111. The adapters 116 and 118 can be positioned along the axial direction 111.

Each of the adapters 116 and 118 can be an electrical conductor or partially conductive. For example, the adapter can have input and output ends that are conductive and a middle part that is not conductive. The input and output ends of the adapter can be connected by a conductive wire or a conductor. In another example, the adapter has a nonconductive body with a conductive surface.

A contact 120 extends along the axial direction between the adapters 116 and 118. The contact 120 can be a conductive contact, e.g., a metallic conductor such as copper (Cu) or aluminum (Al), or a nonmetallic conductor such as graphite or conductive polymer. The contact 120 can be also partially conductive. For example, the contact 120 can have input and output ends that are conductive and a middle part that is not conductive. The input and output ends of the contact 120 can be connected by a conductive wire or conductor. In another example, the contact 120 has a nonconductive body covered with a conductive surface.

As discussed in further details in FIGS. 1, 2A-2B, 3A-3B, and 4A-4B, the contact 120 can be configured as different types and/or shapes or in different combinations with the adapters 116 and 118. For illustration, in FIG. 1, the contact 120 is a cylindrical tube. The cylindrical tube can have an inner surface that is at least partially conductive. The adapters 116 and 118 can have cylindrical bodies with at least partially conductive outer surfaces. The contact 120 and/or the adapters 116 and 118 are sized such that the adapter 116 or 118 can be conductively coupled to the contact 120 or conductively decoupled from the contact 120. The contact 120 and/or the adapters 116 and 118 can be moved relative to one another to get conductively coupled to or conductively decoupled from one another, e.g., by a driver 122 controlled by the control circuit 106 via an electrical wire 124.

When both the adapter 116 and the adapter 118 are conductively coupled to the contact 120, the adapter 116 is conductively coupled to the adapter 118. Consequently, the relay 102 is closed or turned on. When at least one of the adapter 116 or the adapter 118 is conductively decoupled from the contact 120, the adapter 116 is conductively decoupled from the adapter 118. Consequently, the relay 102 is open or turned off.

In some implementations, the contact 120 is movable along the axial direction 111 between the adapters 116 and 118. During the movement of the contact 120, the adapter 116 can be stationary. The adapter 118 can be also stationary or be conductively attached on the contact 120 and moved together with the contact 120. In either case, the adapter 118 maintains conductive coupling with the contact 120 during the movement of the contact 120, e.g., by having the outer surface of the adapter 118 in conductive contact with the inner surface of the contact 120. In a particular example, the adapter 118 includes a flexible member such as an electrical wire electrically coupling the contact 120 to the terminal 114. The flexible member can have a length extensible for the contact 120 moving between a closed position and an open position without breakage during operation.

When the contact 120 is at the closed position, as illustrated in FIG. 1, the adapter 116 has a conductive outer surface in contact with a conductive inner surface of the contact 120, thus the adapter 116 is conductively coupled to the contact 120 and thus conductively coupled to the adapter 118 through the contact 120. Accordingly, the relay 102 is closed. When the contact 120 is moved away from the adapter 116 to an open position (not shown), the adapter 116 can slide out of the cylindrical tube thus be conductively decoupled from the contact 120 and thus conductively decoupled from the adapter 118. Accordingly, the relay 102 becomes open.

In some implementations, the contact 120 is rotatable around the axial direction 111 (or an axis parallel to the axial direction 111) between a closed position and an open position. During the rotation of the contact 120, the adapter 116 can be stationary. The adapter 118 can be also stationary or be conductively attached on the contact 120 and moved together with the contact 120.

The adapter 116 can have a conductive part and a nonconductive part (or a recessed part), e.g., on the outer surface. The contact 120 can also have a conductive part and a nonconductive part (or a recessed part), e.g., on the inner surface. In some examples, when the contact 120 rotates to the closed position, the conductive part of the adapter 116 comes into contact with the conductive part of the contact 120, thus the adapter 116 is conductively coupled to the contact 120. When the contact 120 rotates to the open position, the conductive part of the adapter 116 comes into contact with the nonconductive part of the contact 120 and the nonconductive part of the adapter 116 comes into contact with the conductive part of the contact 120, thus the adapter 116 is conductively decoupled from the contact 120.

In some cases, during the rotation of the contact 120, the adapter 118 maintains conductive coupling with the contact 120, e.g., by having a wholly conductive outer surface in conductive contact with the inner surface of the contact 120. Consequently, the adapter 116 is conductively coupled to the adapter 118 when the contact 120 is at the closed position, and conductively decoupled from the adapter 118 when the contact 120 is at the open position.

In some cases, the adapter 118 also has a conductive part and a nonconductive part (or a recessed part), e.g., on the outer surface. When the contact 120 is at the closed position, the conductive part of the adapter 118 comes into contact with the conductive part of the contact 120, and the adapter 118 is conductively coupled to the contact 120, thereby the adapter 118 is conductively coupled to the adapter 116. When the contact 120 is at the open position, the conductive part of the adapter 118 can coincide with the nonconductive part of the contact 120 or the conductive part of the contact 120. In either case, the adapter 118 is conductively decoupled from the adapter 116 as the adapter 116 is conductively decoupled from the contact 120.

In some implementations, one of the adapters 116 and 118, e.g., the adapter 118, is moved relative to the contact 120 between a closed position and an open position during operation. The movable adapter 118 can be moved along the axial direction 111 or rotated around the axial direction 111. The movable adapter 118 can be conductively coupled to the terminal 114 by a flexible wire extensible for the movement of the adapter 118 between the closed and open positions.

The contact 120 and the other one of the adapters 116 and 118, e.g., the adapter 116, are stationary or fixed during the operation. The contact 120 maintain conductive coupling with the stationary adapter 116. In some examples, the adapter 116 includes a wire conductively coupled to the contact 120, and the contact 120 is conductively coupled to the terminal 112.

When the movable adapter 118 is at the closed position, the movable adapter 118 is conductively coupled to the contact 120, e.g., by having the outer surface of the adapter 118 in conductive contact with the inner surface of the contact 120, thereby the movable adapter 118 is conductively coupled to the adapter 116. Consequently, the relay 102 is closed or turned on. When the movable adapter 118 is moved to the open position, e.g., sliding out of the cylindrical tube of the relay 102, the adapter 118 is conductively decoupled from the contact 120, thereby conductively decoupled from the adapter 116. Consequently, the relay 102 is open or turned off.

In some implementations, the adapter 116 or/and the adapter 118 includes a cylindrical tube. The contact 120 includes a cylindrical body. The adapter 116 or/and the adapter 118 and the contact 120 are sized such that an inner surface of the adapter 116 or/and the adapter 118 is complementary to an outer surface of the contact 120.

As discussed above, the adapter 116 or/and the adapter 118 and the contact 120 can have different shapes and/or types and/or in suitable combinations, such that the contact 120 can be moved (or rotated) relative to at least one of the adapter 116 and the adapter 118, thereby making the adapter 116 conductively coupled to the adapter 118 via the contact 120 to turn on the relay 102 or conductively decoupled from the adapter 118 to turn off the relay 102.

The relay 102 can include a housing 110 enclosing and supporting the adapters 116 and 118, the contact 120, and the driver 122. The housing 110 can be non-conductive. The first and second terminals 112 and 114 can be positioned outside of the housing 110 as connecting ports to the working circuit 104. The relay 102 can be used in a breaker, e.g., a circuit breaker. The housing 110 can be sized to be positioned inside a breaker box, e.g., a residential or light industrial circuit breaker box, to meet installation and regulatory requirements.

The driver 122 can be controlled to move the contact 120 or a movable adapter (e.g., one of the adapters 116 and 118) along the axial direction 111 or rotate the contact 120 around the axial direction 111. In some implementations, the driver 122 includes an electromagnet (e.g., an electromagnetic coil) that can receive a control current from the control circuit 106 and become energized, generating a magnetic force to drive a magnet attached to the contact 120 or the movable adapter and thereby move the contact 120 or the movable adapter. The magnet can be a permanent magnet or be a second electromagnet controlled by a control circuit, e.g., the control circuit 106. In some implementations, the driver 122 includes a rotational motor or a piezoelectric motor.

In some implementations, the contact 120 is moved during operation. The magnet is attached to the contact 120. The magnet can be attached on the contact 120 at any suitable location. For example, if the contact 120 is cylindrical tube, as illustrated in FIG. 1, the magnet can be also a cylindrical tube that fits with an outer surface of the contact 120. The magnet can be attached to the outer surface close to one end of the contact 120, e.g., close to one of the adapter 116 or the adapter 118. The magnet can be also vertically attached on the bottom end of the contact 120. In a particular example, the magnet is attached on the inner surface of the contact 120. The adapter 118 or the adapter 116 can be a flexible wire conductively coupled to the contact 120, such that the adapter 118 or the adapter 116 can be conductively coupled to the contact 120 when the contact 120 is moved.

The driver 122 can be positioned adjacent to the contact 120 or the adapter 116 or 118, e.g., between the contact 120 and the terminal 112 or 114. In some cases, the magnet has axial magnetization with coplanar surfaces of opposed polarities perpendicular to the axial direction 111, and the driver 122 is configured to generate an axial magnetic force to move the magnet and thus the contact 120 along the axial direction 111.

In some cases, the magnet has radial magnetization with coplanar surfaces of opposed polarities parallel to the axial direction 111, and the driver 122 is configured to generate a radial magnetic force to rotate the magnet thus the contact 120 around the axial direction 111 or an axis parallel to the axial direction 111.

The driver 122 can receive a first current, e.g., from the control circuit 106, to generate a first magnetic force to move the magnet and thus the contact 120 from the closed position towards the open position. In some examples, the driver 122 receives a second, opposite current to generate a second magnetic force to move the magnet thus the contact 120 from the open position to the closed position.

Figure 4A:
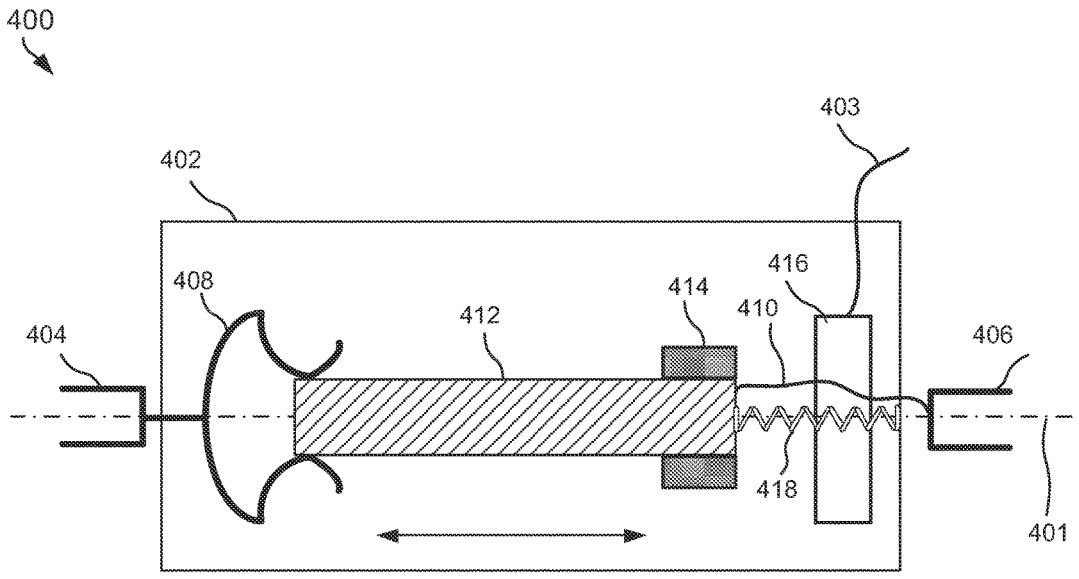
FIG. 4A depicts another example relay with a biasing member in a closed state.
Figure 4B:
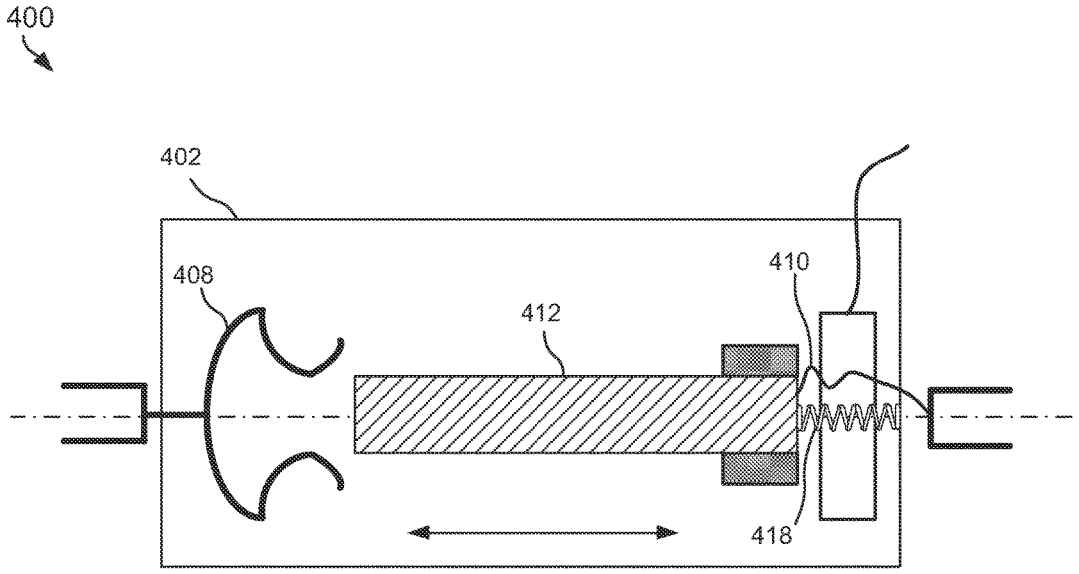
FIG. 4B depicts the example relay of FIG. 4A in an open state.

In some examples, as discussed in further details in FIGS. 4A-4B, the relay 102 includes a biasing member such as a spring configured to bias the contact 120 towards the closed position. The biasing member can be fixed on the contact 120 and a supporter in the housing 110, e.g., a vertical sidewall of the housing 110.

In some examples, the biasing member includes two or more strings attached to opposite sides on the bottom end of the contact 120, e.g., when the contact 120 is a cylindrical tube. In some examples, the biasing member includes one or more strings attached to a middle of the contact 120 when the contact 120 is a cylindrical solid body. In some examples, the biasing member includes one or more strings attached to an adapter that is conductively attached to the contact 120 and moved together with the contact 120 during operation.

When the contact 120 is at the open position, the biasing member can be compressed and exert a force on the contact 120 towards the closed position. When the control current from the control circuit 106 is switched off, the driver 122 is de-energized, and the force exerted by the biasing member can push the contact 120 back to the closed position. Consequently the relay 102 becomes closed.

In some implementations, as noted above, one of the adapters 116 and 118 is moved during operation. The contact 120 and the other one of the adapters 116 and 118 are stationary or fixed during the operation. A magnet can be attached to the movable adapter and the driver 122 can be positioned adjacent to the movable adapter and configured to generate a magnetic force to move the movable adapter along the axial direction or rotate the movable adapter around the axial direction.

The relay 102 can receive a low power signal, e.g., a low control current, from the control circuit 106 to move the contact 120 relative to at least one of the adapters 116 and 118 to turn on or off the relay 102, thereby controlling a flowing current through the working circuit 104 operated under high power, e.g., a high voltage. For example, when the working circuit 104 experiences a fault current condition, e.g., overload, short circuit, or power surge, the system 100 can send a command to the control circuit 106 to provide a control current to the driver 122 of the relay 102. As another example, the control circuit 106 can turn on or off the relay 102 according to a load curtailment scheme. The driver 122 moves the contact 120 relative to at least one of the adapters 116 and 118 to turn off the relay 102 thus to switch off the working circuit 104.

In some implementations, the working circuit 104 provides a positive DC voltage and negative DC voltage through two separate wires. Two respective relays, e.g., the relay 102, can be lined into the two wires to separately control, e.g., switch on or off, power flow through the wires.

FIGS. 2A-2B, 3A-3B, and 4A-4B show different relay configurations including contacts, adapters, terminals, and drivers. The relays can be the relay 102 of FIG. 1. The contacts, the adapters, the terminals, and the drivers can be the contact 120, the adapters 116 and 118, the terminals 112 and 114, and the driver 122 of FIG. 1, respectively.

Figure 2A:
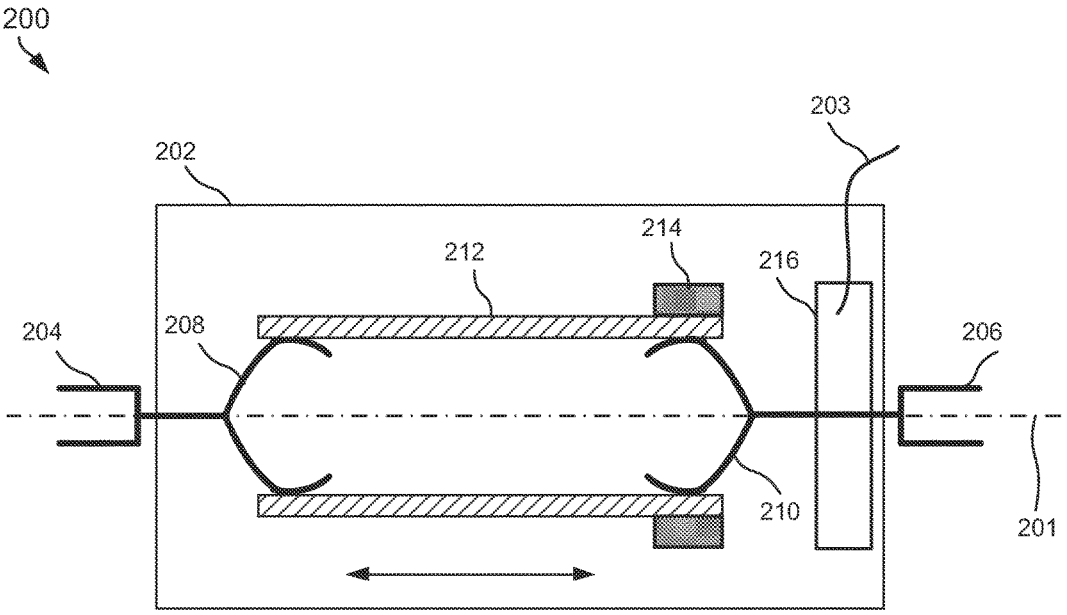
FIG. 2A depicts an example relay with a contact movable along an axial direction in a closed state.
Figure 2B:
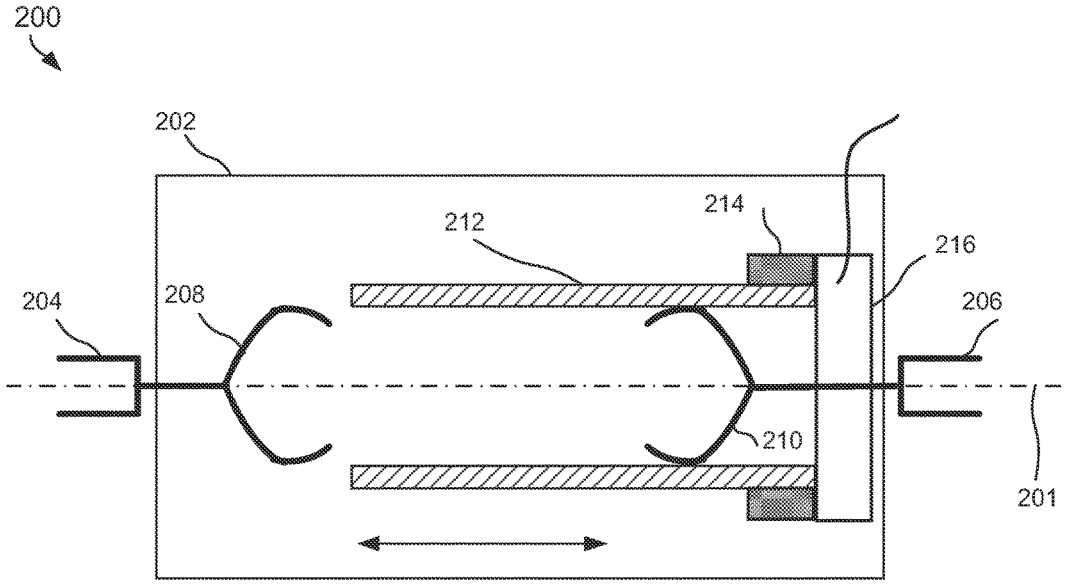
FIG. 2B depicts the example relay of FIG. 2A in an open state.

Referring to FIGS. 2A-2B, a relay 200 includes a contact 212 movable along an axial direction 201. The relay 200 includes a housing 202 enclosing two adapters 208 and 210, the contact 212, a contact magnet 214, and an electromagnet 216.

Terminals 204 and 206 are positioned outside of the housing 202 along the axial direction 201. In the illustrated example in FIGS. 2A-2B, the terminals 204 and 206 have a shape of a crimp or solder cup. The terminals 204 and 206 can be connected to a working circuit, e.g., the working circuit 104 of FIG. 1, by electrical wires.

The contact 212 can be a tube, e.g., a cylindrical tube or a rectangular tube, extending along the axial direction. The contact magnet 214 can be arranged on an outer surface of the contact 212 and positioned close to the adapter 210. The electromagnet 216 is positioned between the contact 212 and a side wall of the housing 202. The electromagnet 216 can be electrically connected to a control circuit, e.g., the control circuit 106 of FIG. 1, via an electrical wire 203.

The adapters 208 and 210 are conductively coupled to the terminals 204 and 206, respectively. Each adapter of the adapters 208 and 210 can have two symmetric spring loaded fingers that each extend inwardly and have an apex, e.g., in the middle of the fingers. The fingers can be conductive. For the two symmetric spring loaded fingers, an apex distance between a top apex of the top finger and a bottom apex is larger than an endpoint distance between a top endpoint of the top finger and a bottom endpoint of the bottom finger. The apex distance can become smaller when the fingers are compressed.

In some examples, the contact 212 or/and the adapters 208 and 210 are sized such that an inner diameter or an inner height of the contact 212 is larger than the endpoint distance but smaller, e.g., slightly smaller, than the apex distance. In some examples, each adapter has two or more fingers, e.g., four fingers, sized and arranged in respect to the contact 212. In some examples, each adapter includes one spring loaded finger.

When the adapter 208 or/and the adapter 210 slides into the contact 212, the fingers of the adapter 208 or/and the adapter 210 is compressed and exerts an force against the inner surface of the contact 212, thereby the top and bottom apexes of the fingers of the adapter 208 or/and the adapter 210 can be in a firm contact with the inner surface of the contact 212. The fingers of the adapter 208 or/and the adapter 210 can be conductive and the inner surface of the contact 212 can be conductive, thus the adapter 208 or/and the adapter 210 can be conductively coupled to the contact 212 when the apexes of the fingers of the adapter 208 or/and the adapter 210 are within the contact 212.

FIG. 2A shows that the contact 212 is at a closed position and the relay 200 is closed. Both fingers of the adapters 208 and 210 are in conductive contact with the inner surface of the contact 212, thereby the adapter 208 is conductively coupled to the adapter 210 via the contact 212.

FIG. 2B shows the contact 212 is at an open position and the relay 200 is open. As noted above, the contact magnet 214 can have axial magnetization with coplanar surfaces of opposed polarities perpendicular to the axial direction 201, and the electromagnet 216 can receive a control current to generate a magnetic force to attract the contact magnet 214 to move the contact magnet 214 and the contact 212 towards the electromagnet 216 along the axial direction. The adapter 208 can be stationary. With relative movement of the contact 212 and the adapter 208, the fingers of the adapter 208 can eventually slide out of the contact 212, thus the apexes of the adapter 208 lose contact with the inner surface of the contact 212, thereby the adapter 208 is conductively decoupled from the contact 212. When the contact 212 is moved between the closed and open positions, the apexes of the fingers of the adapter 210 slides in the contact 212, maintaining in conductive contact with the inner surface of the contact 212.

In some examples, the movement of the contact 212 from the closed position to the open position is stopped when the control current from the control circuit is switched off. In some examples, the movement is stopped when the contact magnet 214 and the contact 212 are stopped by a stopper, e.g., the electromagnet 216, in the housing 202.

In some examples, the movement is stopped when the contact magnet 214 and the contact 212 are stopped by a biasing member mounted between the contact 212 and a supporter, e.g., a vertical sidewall, in the housing 202. The biasing member can include one or more springs. When the contact 212 is moved from the closed position to the open position, the biasing member can be compressed and exert a force on the contact 212 towards the closed position. The movement of the contact 212 stops when the exerted force is subsequently equalized to the magnet force generated by the electromagnet 216.

As noted above, the contact 212 can be moved back to the closed position. In some examples, the electromagnet 216 receives a reverse control current to generate a magnetic force to move the contact magnet 214 and the contact 212 towards the closed position along the axial direction 201. The reverse control current can be switched off when the contact 212 arrives the closed position. The contact 212 can be also stopped by a stopper in the housing 202.

In some examples, a biasing member is attached between the contact 212 and a supporter in the housing 202. The control current from the control circuit can be switched off and the electromagnet 216 can become de-energized, thus the contact 212 can be moved back by a force exerted by the biasing member.

Figure 3A:
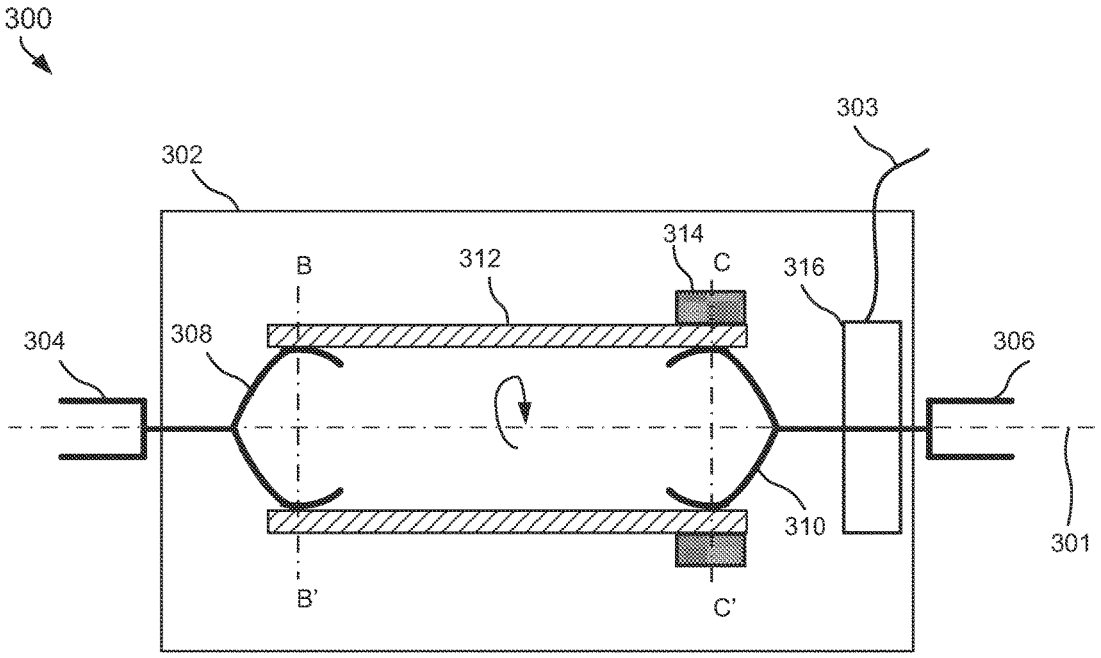
FIG. 3A depicts another example relay with a contact rotatable around an axial direction.
Figure 3B:
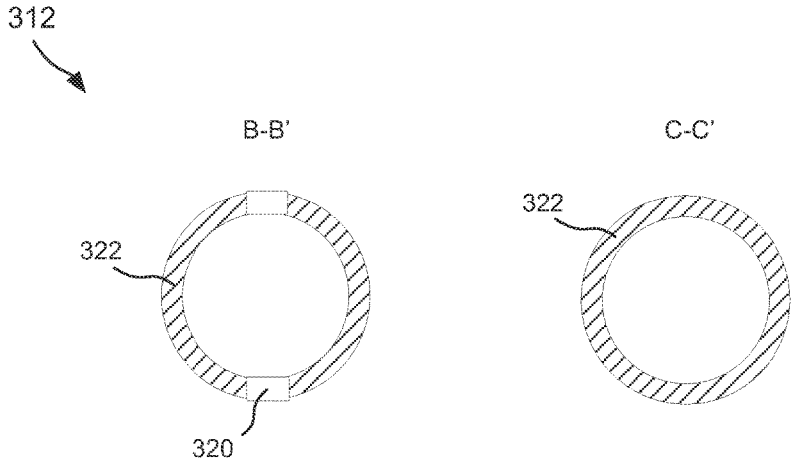
FIG. 3B depicts sectional views of the contact of FIG. 3A.

Referring to FIGS. 3A-3B, a relay 300 includes a contact 312 rotatable along an axial direction 301. The relay 300 includes a housing 302 enclosing two adapters 308 and 310, the contact 312, a contact magnet 314, and an electromagnet 316. Terminals 304 and 306 are positioned outside of the housing 302 along the axial direction 301.

The terminals 304 and 306, the adapters 308 and 310, the contact magnet 314, and the electromagnet 316 can be similar to or the terminals 204 and 206, the adapters 208 and 210, the contact magnet 214, and the electromagnet 216 of FIGS. 2A-2B, respectively. The adapters 308 and 310 are conductively coupled to the terminals 304 and 306, respectively. The contact magnet 314 can be attached on an outer surface of the contact 312 and moved together with the contact 312. The electromagnet 316 is positioned between the contact 312 and a side wall of the housing 302. The electromagnet 316 can be electrically connected to a control circuit, e.g., the control circuit 106 of FIG. 1, via an electrical wire 303.

The contact 312 is a cylindrical tube, extending along the axial direction. Each of the adapters 308 and 310 has two or more symmetric spring loaded fingers that each extend inwardly and have an apex, e.g., in the middle of the fingers. The fingers of the adapters 308 and 310 are conductive. The contact 312 and the adapters 308 and 310 are sized such that the apexes of the fingers of the adapter 308 and the adapter 310 are in contact with an inner surface of the contact 312. For example, the apexes of the fingers of the adapter 308 are in contact with the inner surface of the contact 312 at B-B' location. The apexes of the fingers of the adapter 310 are in contact with the inner surface of the contact 314 at C-C' location.

FIG. 3B shows cross-section views of the contact 312 at the B-B' location and C-C' location. The contact 312 at the B-B' location includes a non-conductive portion 320 and a conductive portion 322. The contact 312 at the C-C' location includes a wholly conductive portion 322 around the cylindrical tube.

As noted above, the contact magnet 314 can have radial magnetization with coplanar surfaces of opposed polarities parallel to the axial direction 301, and the electromagnet 316 can receive a control current to generate a radial magnetic force to rotate the contact magnet 314 thus the contact 312 around the axial direction 301.

The contact 312 can be rotated around the axial direction 310 between a closed position and an open position. During the rotation of the contact 312, the apexes of the fingers of the adapter 310 maintain conductive contact with the inner surface of the contact 312, thus the adapter 310 is conductively coupled to the contact 312.

During the rotation of the contact 312, the apexes of the fingers of the adapter 308 switch to contact with the non-conductive portion 320 or the conductive portion 322. When the contact 312 is at the closed position, the apexes of the fingers of the adapter 308 are in conductive contact with the conductive portion 322, thus the adapter 308 is conductively coupled to the contact 312 and thus the adapter 310. When the contact 312 is at the open position, the apexes of the fingers of the adapter 308 are in contact with the non-conductive portion 320, thus the adapter 308 is conductively decoupled from the contact 312 and thus from the adapter 310.

The electromagnet 316 can receive a control current to generate a magnetic force to rotate the contact magnet 314 and the contact 312, e.g., in a clockwise direction, to the open position and the control current can be switched off when the contact 312 arrives the open position. To move the contact 312 to the closed position, the control current can be switched on such that the electromagnet 316 can be energized to rotate the contact magnet 314 and the contact 312 around a same direction when the contact 312 is moved to the open position. Alternatively, the electromagnet 316 can receive a second, opposite control current to generate a reverse magnetic force to rotate the contact magnet 314 and the contact 312 in an opposite direction, e.g., a counter-clockwise direction, to move the contact 312 back to the closed position.

Referring to FIGS. 4A-4B, a relay 400 includes a contact 412 movable along an axial direction 401. FIG. 4A shows that the contact 412 is at a closed position and the relay 400 is closed or turned on. FIG. 4B shows that the contact 412 is at an open position and the relay 400 is open or turned off.

The relay 400 includes a housing 402 enclosing an adapter 408, an adapter 410, the contact 412, a contact magnet 414, an electromagnet 416, and a biasing member 418. Terminals 404 and 406 are positioned outside of the housing 402.

The terminals 404 and 406, the contact magnet 414, and the electromagnet 416 can be similar to the terminals 204 and 206, the contact magnet 214, and the electromagnet 216 of FIGS. 2A-2B, or the terminals 304 and 306, the contact magnet 314, and the electromagnet 316 of FIG. 3A. The adapter 408 is conductively coupled to the terminal 404. The contact magnet 414 can be attached on an outer surface of the contact 412 and moved together with the contact 412. The electromagnet 416 is positioned between the contact 412 and a side wall of the housing 402. The electromagnet 416 can be electrically connected to a control circuit, e.g., the control circuit 106 of FIG. 1, via an electrical wire 403.

The contact 412 can include a solid body, e.g., a cylindrical block or a rectangular block. The adapter 408 includes two or more symmetric spring loaded fingers that each extend outwardly and have a bottom, e.g., at the middle of the finger. The fingers can be conductive. For the two symmetric spring loaded fingers, a bottom distance between two bottoms of the fingers is larger than an endpoint distance between two endpoints of fingers. The bottom distance can become larger when the fingers are extended outwardly.

The contact 412 and the adapter 408 can be sized such that a diameter or a height of the contact 412 is smaller than the endpoint distance but larger, e.g., slightly larger, than the bottom distance. When the adapter 408 slides onto the contact 412, the fingers of the adapter 408 are extended outwardly and exert a force against the surface of the contact 412, thereby the bottoms of the fingers of the adapter 408 can be in a firm contact with the surface of the contact 412. The fingers of the adapter 408 can be conductive and the surface of the contact 412 can be conductive, thus the adapter 408 can be conductively coupled to the contact 412 when the bottoms of the fingers of the adapter 408 are on the surface of the contact 412.

The adapter 410 can be different from the adapter 408. For illustration, the adapter 410 can be a flexible member such as an electrical wire. The flexible member is conductively coupled to the contact 412 and the terminal 406. The flexible member can be extended without breakage when the contact 412 is moved between a closed position and an open position.

The biasing member 418 can be one or more springs positioned between the contact 312 and a supporter, e.g., a vertical sidewall, of the housing 402, along the axial direction 401. The springs can be attached on the bottom of the contact 412. The biasing member 418 exerts a force biasing the contact 412 towards the closed position.

When the contact 412 is at the closed position, the fingers of the adapter 408 are in conductive contact with the contact 412, thereby the adapter 408 is conductively coupled to the contact 412 and thus the adapter 410 and the terminal 406. The biasing member 418 can be in a relaxed position.

The electromagnet 416 can receive a control current to generate a magnetic force to move the contact 412 to the open position along the axial direction 401. When the contact 412 is at the open position, the fingers of the adapter 408 lose contact with the contact 412 and thus the adapter 408 is conductively decoupled from the contact 412 and thus from the adapter 410 and the terminal 406. The biasing member 418 is in a compressed position that exerts a force on the contact 412 towards the closed position. When the control current is switched off, the electromagnet 416 is de-energized. The biasing member 418 can bias the contact 412 to the closed position.

Figure 5:
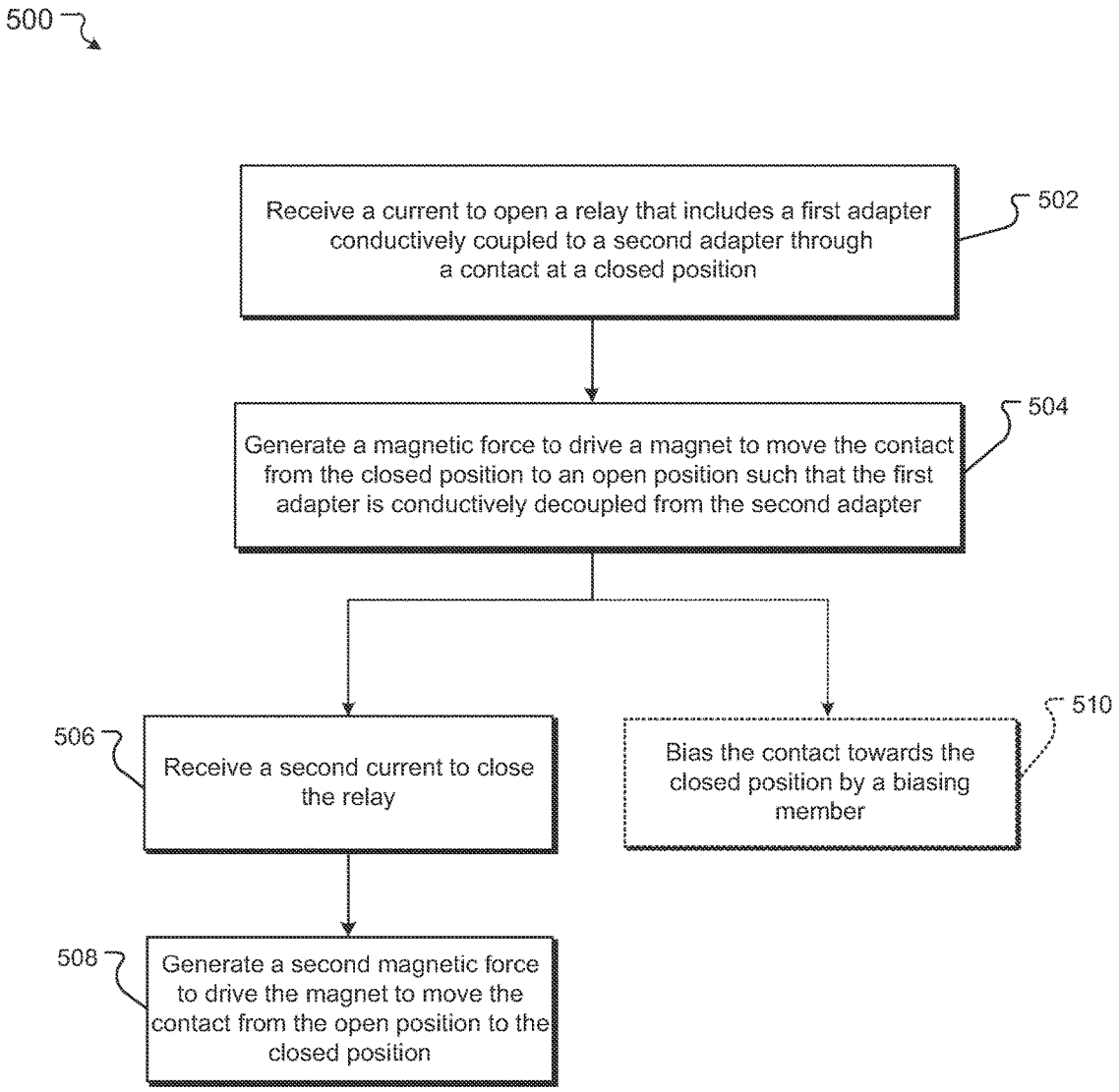
FIG. 5 is a flow chart of an example process performed by a relay.

FIG. 5 shows an example process 500 performed by a relay. The relay can be the relay 102 of FIG. 1, the relay 200 of FIGS. 2A-2B, the relay 300 of FIGS. 3A-3B, or the relay 400 of FIGS. 4A-4B.

The relay includes first and second adapters positioned along an axial direction and a contact extending along the axial direction between the first adapter and the second adapter. The relay also includes a driver configured to move the contact relative to at least one of the first and second adapters between a closed position and an open position, such that the first adapter is conductively coupled to the second adapter via the contact when the contact is at the closed position and the first adapter is conductively decoupled from the second adapter when the contact is at the open position.

A magnet can be attached to the contact or one of the first and second adapters. The driver can include an electromagnet configured to generate an electromagnet force to move the contact along the axial direction or rotate the contact around the axial direction.

The driver receives a current to open the relay (502). The relay can include terminals coupled to a working circuit, such that the working circuit can be switched on or off as a result that the relay is closed or open. In some cases, the working circuit experiences a fault, e.g., overcurrent or short circuit, and a control system can determine the fault and transmit a control current to the driver of the relay to open the relay, thereby switching off the working circuit.

The driver generates a magnetic force to drive the magnet to move the contact from the closed position to the open position such that the first adapter is conductively decoupled from the second adapter (504).

In some cases, the magnet has axial magnetization with coplanar surfaces of opposed polarities perpendicular to the axial direction, and the driver can generate an axial magnetic force to move the magnet and thus the contact along the axial direction. In some cases, the magnet has radial magnetization with coplanar surfaces of opposed polarities parallel to the axial direction, and the driver can generate a radial magnetic force to rotate the magnet thus the contact around the axial direction.

Optionally, the driver receives a second current to close the relay (506) and generates second magnetic force to drive the magnet to move the contact from the open position to the closed position (508).

In some implementations, the relay includes a biasing member positioned between the contact and a fixed supporter, e.g., a sidewall of a housing of the relay. The biasing member can bias the contact towards the closed position (510) when the driver is de-energized, e.g., when the current from the control system is switched off.

While this specification contains many specific implementation details, these should not be construed as limitations on the scope of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

The invention claimed is:

1. A relay comprising:

first and second adapters positioned along an axis defining an axial direction;

a contact extending along the axial direction between the first adapter and the second adapter; and a driver configured to move the contact relative to at least one of the first and second adapters between a first position and a second position by moving the contact along the axial direction, such that a first end of the contact is conductively coupled to the first adapter and a second end of the contact is conductively coupled to the second adapter when the contact is at the first position, and the first adapter is conductively decoupled from the first end of the first adapter when the contact is at the second position.

2. The relay of claim 1, further comprising a magnet attached to the contact, wherein the driver includes an electromagnet configured to generate a magnetic force to move the magnet, thereby moving the contact.

3. The relay of claim 2, wherein the magnet has axial magnetization with coplanar surfaces of opposed polarities perpendicular to the axial direction, and wherein the driver is configured to generate an axial magnetic force to move the magnet and thus the contact along the axial direction.

4. The relay of claim 2, wherein the driver is configured to receive a first current to generate a first magnetic force to move the magnet and thus the contact from the first position towards the second position.

5. The relay of claim 4, wherein the driver is configured to receive a second, opposite current to generate a second magnetic force to move the magnet thus the contact from the second position towards the first position.

6. The relay of claim 4, further comprising a biasing member configured to bias the contact towards the first position.

7. The relay of claim 1, wherein the contact comprises a cylindrical tube having an axis parallel to the axial direction, the tube being sized such that the first adapter can be in touch with an inner surface of the tube when the first adapter is partially within the tube.

8. The relay of claim 7, wherein the first adapter comprises a first spring loaded finger extending inwardly toward the second adapter and having a first apex, and the first apex is in conductive contact with an inner surface of the cylindrical tube when the contact is at the first position and detached from the inner surface of the cylindrical tube when the contact is at the second position, and wherein the second adapter comprises a second spring loaded finger extending inwardly toward the first adapter and having a second apex, and the second apex maintains in conductive contact with the inner surface of the cylindrical tube when the contact moves between the first position and the second position.

9. The relay of claim 1, wherein the first adapter comprises a first spring loaded finger extending outwardly and having a first bottom, and the first bottom is in conductive contact with an outer surface of the contact when the contact is at the first position and detached from the outer surface of the contact when the contact is at the second position.

10. The relay of claim 1, wherein the second adapter comprises a flexible member conductively coupling the second terminal to the contact, the flexible member having a length such that the flexible member maintains the conductive coupling with the contact and the second terminal without breakage when the contact is moved between the first position and the second position.

11. The relay of claim 1, further comprising a magnet coupled to one of the first and second adapters, wherein the contact is conductively coupled to the other one of the first and second adapters, and wherein the driver is configured to generate a magnetic force to move the magnet and thus the one of the first and second adapters.

12. The relay of claim 1, further comprising a housing for enclosing the first and second adapters, the contact, and the driver.

13. The relay of claim 12, further comprising first and second terminals conductively coupled to the first and second adapters, respectively, the first and second terminals being arranged outside of the housing for conductively coupling to a working circuit.

14. A relay comprising:

first and second adapters positioned along an axis defining an axial direction;

a contact extending along the axial direction between the first adapter and the second adapter; and a driver configured to move the contact relative to at least one of the first and second adapters between a first position and a second position by rotating the contact around the axial direction, such that a first end of the contact is conductively coupled to the first adapter and a second end of the contact is conductively coupled to the second adapter when the contact is at the first position, and the first adapter is conductively decoupled from the first end of the first adapter when the contact is at the second position.

15. The relay of claim 14, further comprising a magnet attached to the contact, wherein the driver includes an electromagnet configured to generate a magnetic force to move the magnet, thereby moving the contact.

16. The relay of claim 15, wherein the magnet has radial magnetization with coplanar surfaces of opposed polarities parallel to the axial direction, and wherein the driver is configured to generate a radial magnetic force to rotate the magnet thus the contact around the axial direction.

17. The relay of claim 16, wherein the contact comprises a nonconductive or recess portion, and wherein, when the contact is rotated to the second position, the first adapter is coupled to the nonconductive portion or at the recess portion, such that the first adapter is conductively decoupled from the second adapter.

18. The relay of claim 15, wherein the driver is configured to receive a first current to generate a first magnetic force to move the magnet and thus the contact from the first position towards the second position.

19. The relay of claim 18, wherein the driver is configured to receive a second, opposite current to generate a second magnetic force to move the magnet thus the contact from the second position towards the first position.

20. The relay of claim 14, wherein the contact comprises a cylindrical tube having an axis parallel to the axial direction, wherein the first adapter comprises a first spring loaded finger extending inwardly toward the second adapter and having a first apex, and the first apex is in conductive contact with an inner surface of the cylindrical tube when the contact is at the first position and detached from the inner surface of the cylindrical tube when the contact is at the second position, and wherein the second adapter comprises a second spring loaded finger extending inwardly toward the first adapter and having a second apex, and the second apex maintains in conductive contact with the inner surface of the cylindrical tube when the contact rotates between the first position and the second position.

* * * * *